US009689285B2

(12) United States Patent
Hase

(10) Patent No.: US 9,689,285 B2
(45) Date of Patent: Jun. 27, 2017

(54) SOLENOID VALVE FOR VARIABLE VALVE TIMING CONTROL DEVICES, AND VARIABLE VALVE TIMING CONTROL SYSTEM

(75) Inventor: Hirofumi Hase, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1698 days.

(21) Appl. No.: 12/989,750

(22) PCT Filed: Mar. 19, 2009

(86) PCT No.: PCT/JP2009/001246

§ 371 (c)(1),
(2), (4) Date: Oct. 26, 2010

(87) PCT Pub. No.: WO2010/007712

PCT Pub. Date: Jan. 21, 2010

(65) Prior Publication Data

US 2011/0048348 A1 Mar. 3, 2011

(30) Foreign Application Priority Data

Jul. 17, 2008 (JP) ..... 2008-186003

(51) Int. Cl.
*F01L 1/34* (2006.01)
*F01L 1/344* (2006.01)
*F01L 1/02* (2006.01)

(52) U.S. Cl.
CPC ..... *F01L 1/3442* (2013.01); *F01L 1/022* (2013.01); *F01L 1/024* (2013.01);
(Continued)

(58) Field of Classification Search
CPC ..... F01L 1/022; F01L 1/3442; F01L 1/024; F01L 2001/34426; F01L 2001/3443; F01L 2001/34479; F01L 2001/34483
(Continued)

(56) References Cited

U.S. PATENT DOCUMENTS 2,547,929 A * 4/1951 Dawson ..... 137/625.23
3,174,510 A * 3/1965 Nelson ..... 137/625.69
(Continued)

FOREIGN PATENT DOCUMENTS

DE 19538916 A1 * 4/1997 ..... B60T 15/04
DE 19729935 A1 1/1999
(Continued)

*Primary Examiner* — Zelalem Eshete
(74) *Attorney, Agent, or Firm* — Birch, Stewart, Kolasch & Birch, LLP

(57) ABSTRACT

A solenoid valve 30 includes a spool 41 moving within a valve housing 40 in a direction of an axis thereof to adjust a fed or discarded amount of a working fluid flowing via ports 43 to 47 formed in the valve housing 40 according to an amount of the movement, and including lands 41*a*, 41*b*, 41*c*, and 41*d* and recessed portions 41*e*, 41*f*, and 41*g* for connecting the lands with one another, and a solenoid unit 50 containing a moving member of a magnetic circuit for driving the spool 41. In edge portions 41*b*' and 41*c*' of the lands 41*b* and 41*c* or in hole edge portions of the valve housing corresponding to the edge portions 41*b*' and 41*c*', notch portions 60 or taper grooves 61, or penetrating holes 62 for adjusting the amount of the working fluid which is close to a central current value are formed.

6 Claims, 6 Drawing Sheets

(52) U.S. Cl.
CPC ..... *F01L 2001/3443* (2013.01); *F01L 2001/34426* (2013.01); *F01L 2001/34479* (2013.01); *F01L 2001/34483* (2013.01)

(58) Field of Classification Search
USPC ..... 123/90.15, 90.17, 90.31; 137/625.43, 137/625.65, 625.69
See application file for complete search history.

(56) References Cited

U.S. PATENT DOCUMENTS

| | | | | | |
|---|---|---|---|---|---|
| 3,212,522 | A | * | 10/1965 | Williams | 137/596.12 |
| 3,882,883 | A | * | 5/1975 | Droegemueller | 137/270 |
| 4,051,868 | A | * | 10/1977 | Andersen | 137/596.13 |
| 4,584,781 | A | * | 4/1986 | Parkinson et al. | 34/92 |
| 4,981,159 | A | * | 1/1991 | Christensen et al. | 137/625.69 |
| 5,878,782 | A | * | 3/1999 | Nakajima | 137/625.65 |
| 6,006,708 | A | * | 12/1999 | Ken et al. | 123/90.17 |
| 6,129,060 | A | * | 10/2000 | Koda | 123/90.17 |
| 6,591,799 | B1 | | 7/2003 | Hase et al. | |
| 8,356,545 | B2 | * | 1/2013 | Stellwagen | 91/446 |
| 2004/0069359 | A1 | * | 4/2004 | Buttner | 137/625.69 |
| 2004/0244852 | A1 | | 12/2004 | Cornea et al. | |
| 2005/0252467 | A1 | | 11/2005 | Strauss et al. | |
| 2006/0144451 | A1 | | 7/2006 | Satoh | |
| 2008/0066572 | A1 | | 3/2008 | Takahashi et al. | |

FOREIGN PATENT DOCUMENTS

| | | | | | |
|---|---|---|---|---|---|
| DE | 10319831 | A1 | | 11/2004 | |
| DE | 102004038252 | A1 | | 12/2005 | |
| DE | 102007000734 | A1 | | 3/2008 | |
| JP | 6-185317 | A | | 7/1994 | |
| JP | 9-79395 | A | | 3/1997 | |
| JP | 10-259705 | A | | 9/1998 | |
| JP | 2003-214552 | A | | 7/2003 | |
| JP | 2004-301190 | A | | 10/2004 | |
| WO | WO 9937929 | A1 | * | 7/1999 | F15B 11/044 |
| WO | WO 02/04789 | A1 | | 1/2002 | |
| WO | WO 02/084081 | A1 | | 10/2002 | |

* cited by examiner

SOLENOID VALVE FOR VARIABLE VALVE TIMING CONTROL DEVICES, AND VARIABLE VALVE TIMING CONTROL SYSTEM

FIELD OF THE INVENTION

The present invention relates to a solenoid valve and a variable valve timing control system that control a variable valve timing control device for changing the opening and closing timing of an intake valve and that of an exhaust valve.

BACKGROUND OF THE INVENTION

Conventionally, there has been provided a known structure of, when driving a camshaft by using a timing pulley and a chain sprocket which rotate in synchronization with an engine crankshaft, rotating the camshaft relatively to the crankshaft by using a variable valve timing device of vane type disposed between the timing pulley and the camshaft so as to retard or advance the angle of the rotation of the camshaft with respect to the rotation of the crankshaft to shift the operating timing of an intake valve and that of an exhaust valve with respect to the rotation of the engine, thereby reducing the exhaust gas and providing an improvement in the fuel consumption.

In addition, as a solenoid valve for controlling the above-mentioned variable valve timing device, there has been provided a solenoid valve described in, for example, patent reference 1. An example of this type of solenoid valve is shown in FIG. 8. This solenoid valve 30 consists of a spool 41 which is driven by a solenoid unit 50, and a valve housing 40 for accommodating the spool 41 therein in such a way that the spool 41 can slide in a direction of the axis thereof, in which an oil passage is formed. In this valve housing 40, an oil supply port 45 which is opened and closed by the spool 41 and which communicates with an oil supply source, and advance angle side and retard angle side ports 43 and 44 which can communicate with the variable valve timing device are disposed. In addition, communicating paths 90 which can communicate between the oil supply port 45 and the advance angle side and retard angle side ports 43 and 44 respectively are formed.

When performing an operation of intermediately holding the variable valve timing device, the solenoid valve 30 controls the variable valve timing device by blocking the hydraulic pressure supply to the variable valve timing device to supply an oil flow having a very low amount of flow to the variable valve timing device. At that time, an oil leakage from the oil passage and so on occurs, and therefore the stability of the intermediately holding operation degrades. To solve this problem, in the solenoid valve disclosed in patent reference 1, the communicating path 90 is disposed to supply an amount of oil which can compensate with the amount of oil leaking from the oil passage and so on so as to ensure the stability in the operation of intermediately holding the variable valve timing control device.

[Patent reference 1] JP,2003-214552,A

Because the conventional solenoid valve for variable valve timing control device is constructed as mentioned above, the conventional solenoid valve can increase the amount of oil supply via the communicating path in the operation of intermediately holding the variable valve timing device while the solenoid valve supplies oil having a large amount of flow to the oil supply port when, for example, operating the variable valve timing control device on an advance angle side. A problem with the conventional solenoid valve is that at that time, the oil is supplied through the communicating path because the advance angle side port serves as a supply of the oil while because the retard angle side port serves as an outlet of the oil, there occurs a state in which a part of the oil fed via the oil supply port is always discharged via the communicating path, and the amount of oil leakage increases in the whole solenoid valve.

The present invention is made in order to solve the above-mentioned problem, and it is therefore an object of the present invention to provide a solenoid valve for variable valve timing control devices and a variable valve timing control system that can prevent the amount of oil leakage from increasing in the whole solenoid valve when operating the variable valve timing control device on an advance angle or retard angle side and that can ensure an adequate amount of oil supply when operating the variable valve timing control device in an intermediate holding state.

DESCRIPTION OF THE INVENTION

In accordance with the present invention, there is provided a solenoid valve for variable valve timing control devices including: a valve housing of cylindrical shape in which a plurality of ports for supplying and discarding the above-mentioned working fluid to and from the above-mentioned variable valve timing control device are formed; a spool moving within the above-mentioned valve housing in a direction of an axis thereof to adjust the fed or discarded amount of the above-mentioned working fluid flowing via the above-mentioned ports according to an amount of the above-mentioned movement, and including a plurality of lands each consisting of a large-diameter portion, and recessed portions each consisting of a small-diameter portion for connecting the above-mentioned plurality of lands with one another; and a solenoid unit containing a plunger which is a moving member of a magnetic circuit for driving the above-mentioned spool, in which a groove portion for adjusting the amount of the working fluid which is close to an intermediate current value is formed in either an edge portion of the above-mentioned plurality of lands or a hole edge portion of the valve housing corresponding to the above-mentioned edge portion.

In accordance with the present invention, because the solenoid valve includes: the valve housing of cylindrical shape in which a plurality of ports for supplying and discarding the above-mentioned working fluid to and from the above-mentioned variable valve timing control device are formed; the spool moving within the above-mentioned valve housing in a direction of the axis thereof to adjust the fed or discarded amount of the above-mentioned working fluid flowing via the above-mentioned ports according to the amount of the above-mentioned movement, and including the plurality of lands each consisting of a large-diameter portion, and the recessed portions each consisting of a small-diameter portion for connecting the above-mentioned plurality of lands with one another; and the solenoid unit containing the plunger which is a moving member of the magnetic circuit for driving the above-mentioned spool, and the groove portion for adjusting the amount of the working fluid which is close to the intermediate current value is formed in either an edge portion of the above-mentioned plurality of lands or a hole edge portion of the valve housing corresponding to the above-mentioned edge portion, when performing an operation of intermediately holding the variable valve timing control device, i.e., even when controlling the solenoid valve with a current close to the intermediate current value, the amount of flow of the working fluid can be increased, and the variable valve timing control device can be controlled with stability. Furthermore, the fluid characteristics of the working fluid can be adjusted by using the groove portion. In addition, when controlling the variable valve timing control device toward an advance angle or retard angle side, oil leakage can be suppressed.

PREFERRED EMBODIMENTS OF THE INVENTION

Hereafter, in order to explain this invention in greater detail, the preferred embodiments of the present invention will be described with reference to the accompanying drawings.

Embodiment 1

Figure 1:
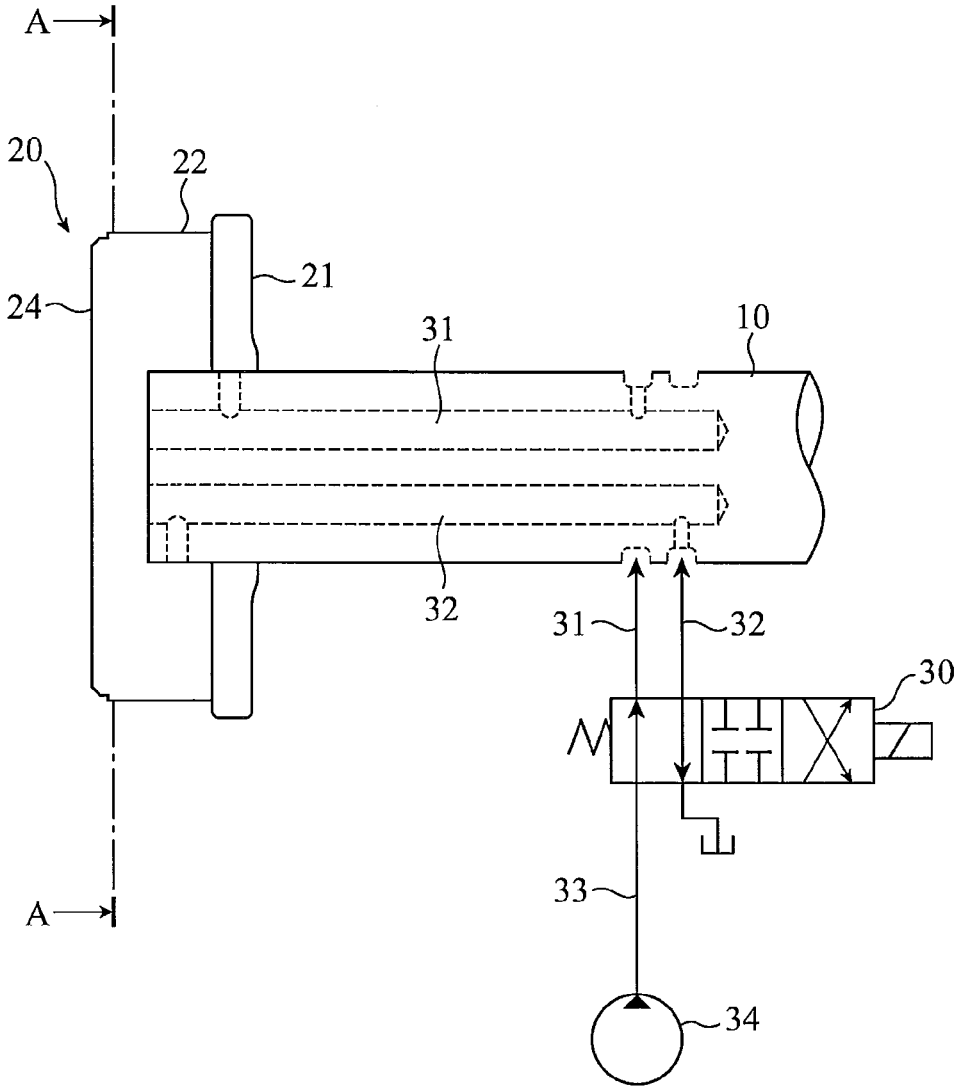
FIG. 1 is a view showing the structure of a variable valve timing control system in accordance with Embodiment 1.
Figure 2:
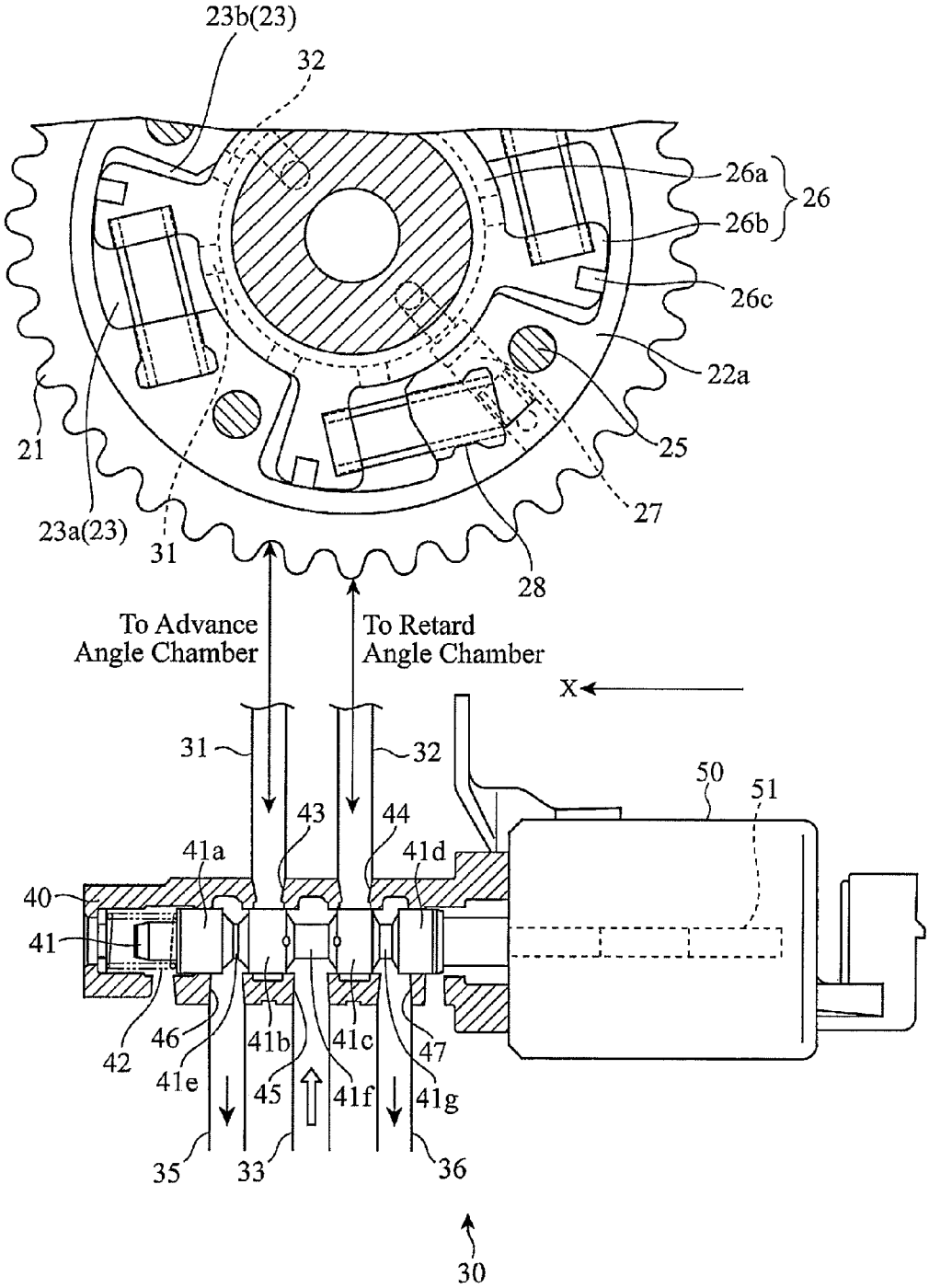
FIG. 2 is a view showing the structure of a variable valve timing control device and a solenoid valve in accordance with Embodiment 1.

FIG. 1 is a view showing the structure of a variable valve timing control system in accordance with Embodiment 1, and FIG. 2 is a view showing the structure of a variable valve timing control device and a solenoid valve in accordance with Embodiment 1. FIG. 2 showing the variable valve timing control device is a cross-sectional view taken along the A-A line of FIG. 1.

The variable valve timing (referred to as VVT from here on) control system is comprised of a camshaft 10 disposed on an exhaust side of an engine, the VVT control device 20 disposed at an end of the camshaft 10, for controlling a relative phase angle of the camshaft 10 with respect to a crankshaft (not shown) of the engine, the solenoid valve 30 connected to the camshaft via an advance angle side oil passage 31 and a retard angle side oil passage 32 which are formed inside the crankshaft, an oil pump 34 for supplying oil to the solenoid valve 30 via an oil supply passage 33, and so on.

The VVT control device 20 is comprised of a housing 21 that rotates in synchronization with the crankshaft, a case 22 having a plurality of shoes 22*a* protruding toward an interior thereof to form oil pressure chambers 23, a cover 24 for covering the oil pressure chambers 23 of this case 22 from a side opposite to the side of the housing 21, and fastening bolts 25 for integrally fixing the housing 21, the case 22, and the cover 24.

The rotor 26 disposed inside the case 22 is comprised of a boss portion 26*a* and a plurality of vanes 26*b* each protruding from the outer periphery of this boss portion 26*a* toward a radial outward direction and dividing one oil pressure chamber 23 into an advance angle side oil pressure chamber 23*a* and a retard angle side oil pressure chamber 23*b*. In addition, a sealing member 26*c* which is in contact with a shoe 22*a* to block an oil flow between the advance angle side oil pressure chamber 23*a* and the retard angle side oil pressure chamber 23*b* is disposed at a leading end portion of each of the vanes 26*b* of the rotor 26. Between this sealing member 26*c* and the advance angle side oil pressure chamber 23*a*, a locking mechanism 27 for locking a relative position between rotary members located outside, such as the housing 21, the case 22, and the cover 24, and the rotor 26 which is a rotary member located inside is disposed. In addition, between each of the vanes 26*b* of the rotor 26, and the corresponding shoe 22*a* of the case 22, an assisting spring 28 for pushing the vane 26*b* in a direction of an advance angle is disposed.

The solenoid valve 30 is substantially comprised of a cylindrical valve housing 40, a spool 41 accommodated in this valve housing 40, a coil spring 42 for pushing this spool 41 toward an initial position of the spool (toward a side of the solenoid unit 50), and the solenoid portion 5 for causing the spool 41 to slide in a direction of an arrow X against the spring force of the coil spring 42. In the outer periphery of the valve housing 40, an advance angle side port 43, a retard angle side port 44, an oil supply port 45, an advance angle side drain port 46, and a retard angle side drain port 47 which correspond to the advance angle side oil passage 31, the retard angle side oil passage 32, the oil supply passage 33, an advance angle side drain passage 35, and a retard angle side drain passage 36 respectively are formed. The advance angle side port 43 and the retard angle side port 44 are disposed diagonally opposite to the oil supply port 45, the advance angle side drain port 46, and the retard angle side drain port 47.

On the outer periphery of the spool 41, a first land portion 41*a*, a second land portion 41*b*, a third land portion 41*c*, and a fourth land portion 41*d* each having an outer diameter equal to the inner diameter of the valve housing 40 are formed, and recessed portions 41*e*, 41*f*, and 41*g* are formed between the first land portion 41*a* and the second land portion 41*b*, between the second land portion 41*b* and the third land portion 41*c*, and between the third land portion 41*c* and the fourth land portion 41*d* respectively. The second land portion 41*b* has a length in a direction of the axis of the spool 41 which is slightly greater than the width of an opening of the advance angle side port 43 of the valve housing 40, and the second land portion 41*c* has a length in the direction of the axis of the spool 41 which is slightly greater than the width of an opening of the retard angle side port 44 of the valve housing. One end of the valve housing 40 is fixed to the housing of the solenoid unit 50, and another end of the spool 41 is brought into contact with a rod 51 disposed within the solenoid unit 50.

In the solenoid valve 30 constructed in this way, a magnetic attraction force occurs in the solenoid unit 50 according to a control signal which is outputted from an ECU (not shown) on the basis of information about the engine's operational status, the rod 51 moves in the direction of the arrow X according to this magnetic attraction force, and the spool 41 brought into contact with the end portion of this rod 51 also slides in the axial direction integrally with the rod. Because the amount of sliding stroke of the spool 41 varies in proportion to the current value applied to the solenoid unit 50, the spool can be controlled by changing the current value according to the engine's operational status. By using the sliding movement of this spool 41, a control operation of relatively switching between the advance angle side oil passage 31 and the retard angle side oil passage 32, and between the oil supply passage 33 and the advance angle side drain passage 35 or the retard angle side drain passage 36 is carried out.

Figure 3:
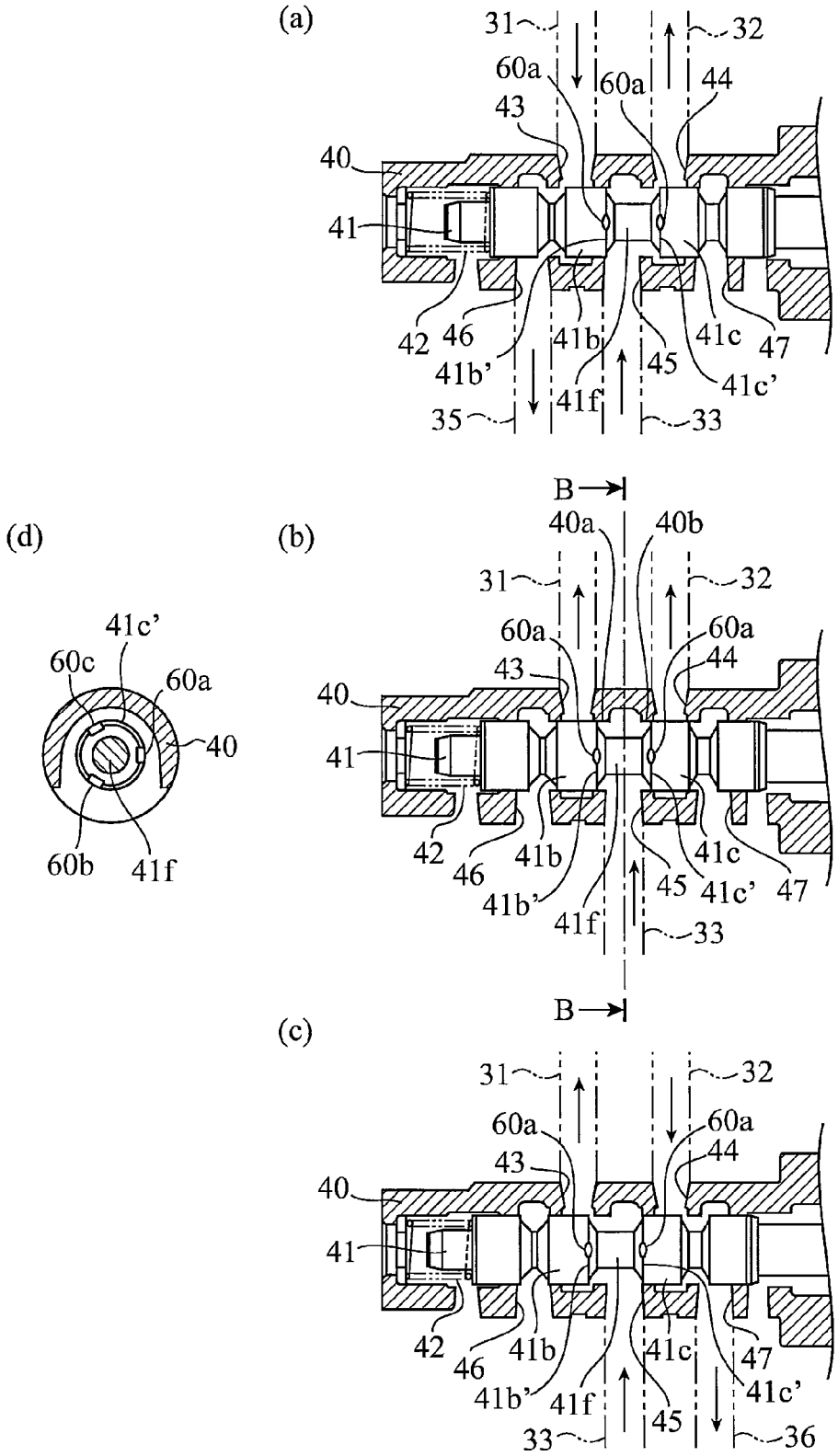
FIG. 3 is a view showing the structure of the solenoid valve in accordance with Embodiment 1.

FIG. 3 is a view showing the structure of the valve housing and the spool of the solenoid valve in accordance with Embodiment 1. In addition, FIG. 3(*a*) is a view showing the solenoid valve when operating the VVT control device on a retard angle side, FIG. 3(*b*) is a view showing the solenoid valve when performing an operation of intermediately holding the VVT control device, and FIG. 3(*c*) is a view showing the solenoid valve when operating the VVT control device on an advance angle side. FIG. 3(*d*) is a cross-sectional view taken along the B-B line of FIG. 3(*b*). First, the control operation of relatively switching between the advance angle side oil passage 31 and the retard angle side oil passage 32, and between the oil supply passage 33 and the advance angle side drain passage 35 or the retard angle side drain passage 36, which is carried out by the solenoid valve 30, will be explained with reference to FIGS. 3(*a*), 3(*b*), and 3(*c*).

When operating the VVT device 20 on a retard angle side as shown in FIG. 3 (*a*), the spool 41 slides to a predetermined position against the spring force of the coil spring 42 according to the current value applied to the solenoid portion 50, so that the advance angle side oil passage 31 and the advance angle side drain passage 35 communicate with each other, and the oil supply passage 33 and the retard angle side oil passage 32 communicate with each other. As a result, oil is introduced into the retard angle side oil pressure chambers 23*b* via the oil supply passage 33 and the retard angle side oil passage 32, and oil is discharged from the advance angle side oil pressure chambers 23*a* via the advance angle side oil passage 31 and the advance angle side drain passage 35. Also when the VVT control device 20 is controlled at a reference position, and the energization of the solenoid valve 30 is in an OFF state, the control state as shown in FIG. 3(*a*) is maintained.

When performing the operation of intermediately holding the VVT device 20 as shown in FIG. 3(*b*), the spool 41 slides to a predetermined position against the spring force of the coil spring 42 according to the current value applied to the solenoid unit 50, so that the oil supply passage 33 is kept in a state in which the oil supply passage 33 does not communicate with any of the advance angle side oil passage 31 and the retard angle side oil passage 32. Also in the state in which the oil supply passage 33 does not communicate with any of the advance angle side oil passage 31 and the retard angle side oil passage 32, in addition to oil leaking from the clearance part between the second land portion 41*b* and a partition portion 40*a* of the valve housing 40 and oil leaking from the clearance part between the third land portion 41*c* and a partition portion 40*b* of the valve housing 40, an amount of flow of oil flowing through notch portions 60*a*, 60*b*, and 60*c*, which will be mentioned below, is supplied to the advance angle side oil passage 31 and the retard angle side oil passage 32.

When operating the VVT device 20 on an advance angle side as shown in FIG. 3 (*c*), the spool 41 slides to a predetermined position against the spring force of the coil spring 42 according to the current value applied to the solenoid portion 50, so that the oil supply passage 33 and the advance angle side oil passage 31 communicate with each other, and the retard angle side oil passage 32 and the retard angle side drain passage 36 communicate with each other. As a result, the oil is introduced into the advance angle side oil pressure chambers 23*a* via the oil supply passage 33 and the advance angle side oil passage 31, and the oil is discharged from the retard angle side oil pressure chambers 23*b* via the retard angle side oil passage 32 and the retard angle side drain passage 36.

Next, the notch portions 60 respectively formed in the second land portion 41*b* and the third land portion 41*c* will be explained with reference to FIGS. 3(*b*) and 3(*d*). The three notch portions 60*a*, 60*b*, and 60*c* are formed at equal intervals in the circumference of each of edge portions 41*b*' and 41*c*' of the second land portion 41*b* and the third land portion 41*c* which face each other. The notch portions 60*a*, 60*b*, and 60*c* in the edge portion 41*b*' are formed at positions opposite to those at which the notch portions 60*a*, 60*b*, and 60*c* in the edge portion 41*c*' are formed, and the notch portions 60*a*, 60*b*, and 60*c* in the edge portion 41*b*' are formed to have the same shapes as those in the edge portion 41*c*'. By disposing each notch portion 60 having the same shape at the opposite position in each edge portion, the oil supplied to the advance angle side oil passage 31 has the same flow amount characteristic as that supplied to the retard angle side oil passage 32.

Figure 4:
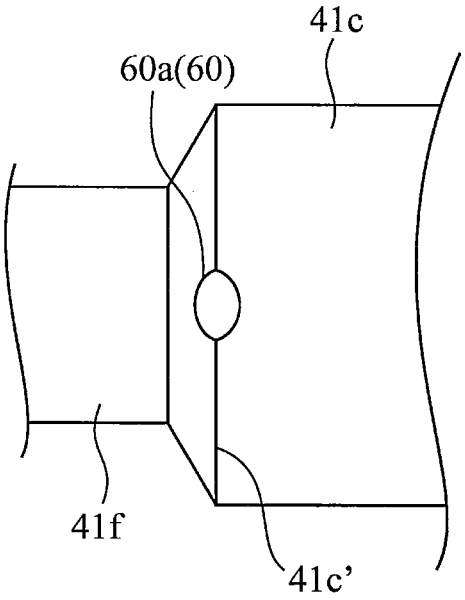
FIG. 4 is a view showing the structure of a notch portion of the solenoid valve in accordance with Embodiment 1.

FIG. 4 is a view showing the notch portion 60*a* formed in the edge portion 41*c*' of the third land portion 41*c*. The notch portion 60*a* is formed by notching an arc-shaped portion in the edge portion 41*c*' of the third land portion 41*c*. More specifically, the notch portion 60*a* is formed by notching the arc-shaped portion in such a way that its width in a direction of the circumference of the edge portion varies gradually along the direction of the axis of the spool 41. In addition, because the notch portion 60*a* is shaped like an arc of less than a semicircle, and the edge portion 41*c*' and the notch portion 60*a* cross each other at an angle of 90 degrees or more, burrs can be prevented from occurring when the spool is machined. For example, as a method of forming the notch portions 60, a machining method of cutting the spool along an inward diameter direction of the second and third land portions 41*b* and 41*c* by using an end mill or the like can be provided. Because the notch portions 60 can be formed with cutting which enables high-accuracy machining, the flow amount characteristic of the oil can be adjusted with a high degree of accuracy.

By forming the plurality of notch portions 60*a*, 60*b*, and 60*c* in each of the second and third land portions 41*b* and 41*c*, the flow of the oil supplied from the oil supply passage 33 to each of the advance angle side passage 31 and the retard angle side oil passage 32 increases, and the oil flow rate required to stably maintain the operation of intermediately holding the VVT control device 20 can be ensured sufficiently. Next, a relationship between the control current value and the oil flow rate of the solenoid valve 30 will be explained.

Figure 5:
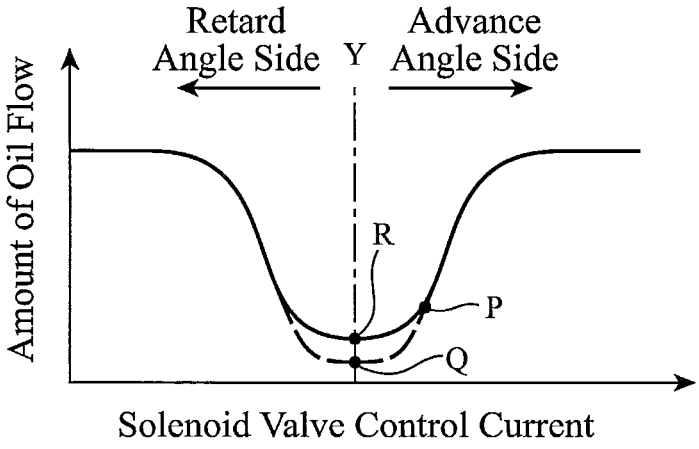
FIG. 5 is a graph showing a relationship between a current and an amount of oil flow in the solenoid valve in accordance with Embodiment 1.

FIG. 5 is a graph showing the relationship between the control current value to the solenoid valve 30, and the oil flow rate in the solenoid valve 30 corresponding to the opening of the solenoid valve 30.

The opening of each of the advance angle side oil passage 31 and the retard angle side oil passage 32 of the solenoid valve 30 is determined by the control current value applied from the ECU to the solenoid unit 50, as shown in FIG. 5. More specifically, when the solenoid valve control current value falls within a region on a retard angle side of a center line Y, the oil supply passage 33 communicates with the retard angle side oil passage 32, as shown in FIG. 3(*a*), and, in order to move the VVT control device 20 toward the direction of the retard angle, an oil pressure is supplied to the retard angle side oil pressure chambers 23*b* and a flow of the oil is set up in such a way that the oil pressure of the advance angle side oil pressure chambers 23*a* is discharged. In this retard angle side region, as the control current value decreases, the opening of the retard angle side port 44 increases and therefore the flow rate of the oil fed to the retard angle side oil pressure chambers 23*b* increases.

In this retard angle side region, because the notch portions 60 formed in the second and third land portions 41*b* and 41*c* are placed in an oil supply side portion via which the oil supply passage 33 and the retard angle side oil passage 32 communicate with each other, and therefore the notch portions 60 are sealed by the inner diameter portion of the valve housing 40 corresponding to the notch portions 60, no oil is discharged into the advance angle side drain passage 35 via the notch portions 60 and the amount of leakage of oil does not increase in the whole solenoid valve 30.

In contrast, when the solenoid valve control current value falls within a region on an advance angle side of the center line Y, the oil supply passage 33 communicates with the advance angle side oil passage 31, as shown in FIG. 3(*c*), and, in order to move the VVT control device 20 toward the direction of the advance angle, an oil pressure is supplied to the advance angle side oil pressure chambers 23*a* and a flow of the oil is set up in such a way that the oil pressure of the retard angle side oil pressure chambers 23*b* is discharged. In this advance angle side region, as the control current value increases, the opening of the advance angle side port 43 increases and therefore the flow rate of the oil fed to the advance angle side oil pressure chambers 23*a* increases.

In this advance angle side region, because the notch portions 60 formed in the second and third land portions 41*b* and 41*c* are placed in an oil supply side portion via which the oil supply passage 33 and the advance angle side oil passage 31 communicate with each other, and therefore the notch portions 60 are sealed by the inner diameter portion of the valve housing 40 corresponding to the notch portions 60, no oil is discharged into the retard angle side drain passage 36 via the notch portions 60 and the amount of leakage of oil does not increase in the whole solenoid valve 30.

Furthermore, there is a case in which an intermediate current value shown by the center line Y becomes the control current value (a point R or Q) according to the engine's operational status.

In a case in which the assisting springs 28 each for pushing a vane 26*b* toward the advance angle side is disposed in the VVT control device 20, as represented by an exhaust-side VVT control device, there exists a point at which the torque of the camshaft 10 in the direction of the retard angle and the energization torque by the assisting springs 28 are balanced according to the engine's operational status. Usually, in a case of intermediately holding the VVT control device 20 at this balanced point, the solenoid valve 30 is controlled with the intermediate current value (point Q). In the solenoid valve 30 at the time of the operation of intermediately holding the VVT control device 20, the oil supply passage 33 does not communicate with any of the advance angle side oil passage 31 and the retard angle side oil passage 32, as shown in FIG. 3(*b*), and the oil leaking from the clearance part between the second land portion 41*b* and the partition portion 40*a* and the oil leaking from the clearance part between the third land portion 41*c* and the partition portion 40*b* are supplied to the advance angle side oil pressure chambers 23*a* and the retard angle side oil pressure chambers 23*b*.

In the case of thus holding the VVT control device with the intermediate current value (point Q), the amount of supplied flow from the solenoid valve 30 includes only the amount of flow from the clearances, and therefore decreases remarkably. On the other hand, the varying torque of the camshaft 10 acts on the rotor 26, and therefore the rotor 26 wobbles around a target control angle and within an angle range of about 2 degrees. This wobbling causes oil pressure pulsations to occur in the oil pressure chambers 23*a* and 23*b* and the oil passages 31 and 32. Oil leaking from clearances between components exists in each of the oil pressure chambers 23*a* and 23*b* and the oil passages 31 and 32 which are disposed inside the VVT adjusting device 20. The oil pressure pulsations may increase the oil leakage from these clearances. Thus, when the oil leakage is large, a shortage of the amount of supplied oil occurs and it becomes difficult to control the VVT adjusting device 20 with stability. To solve this problem, oil is supplied via the plurality of notch portions 60 formed in each of the second and third land portions 41*b* and 41*c*, and the amount of oil flow to each of the advance angle side and retard angle side oil passages 31 and 32 is increased. By forming these notch portions 60, also at the intermediate current value, the amount of oil flow can be maintained at the point R, and an amount of oil flow enough to control the operation of intermediately holding the VVT control device 20 with stability can be ensured.

In contrast, in a case in which no assisting springs 28 are disposed in the VVT control device 20, as represented by an intake-side VVT control device, in order to hold the VVT adjusting device 20 at the intermediate position against the torque of the camshaft 10 in the direction of the retard angle, the solenoid valve 30 is always controlled at the point P having a current value larger than the intermediate current value. Because oil having a larger amount of flow than the amount of oil flow leaking from the clearance parts between the second and third land portions 41*b* and 41*c* and the partition portions 40*a* and 40*b* is supplied to the advance angle side oil pressure chambers 23*a* at the solenoid valve control current (the point P), it is rare to impair the stability of the operation of intermediately holding the VVT adjusting device 20.

As mentioned above, because the solenoid valve in accordance with this Embodiment 1 is constructed in such a way that the notch portions 60 are disposed in each of the edge portions 41*b*' and 41*c*' of the second and third land portions 41*b* and 41*c*, also when the solenoid valve 30 is controlled by using the solenoid valve control current having a value close to the intermediate current value, the oil flows via the notch portions 60 can increase the amount of oil flow to the advance angle side and retard angle side oil passages 31 and 32, and the VVT adjusting device 20 can be controlled with stability. In addition, the flow amount characteristic of the oil supplied to the advance angle side and retard angle side oil passages 31 and 32 can be equalized. Furthermore, the amount of flow in the intermediate holding area which is used at the highest frequency at the time when the solenoid valve works while being mounted in a real vehicle travelling can be increased, contamination and oil sludge which occur when, for example, the amount of flow is small and therefore oil resides in the OCV can be prevented from accumulating within the OCV.

Furthermore, because the solenoid valve in accordance with this Embodiment 1 is constructed in such a way that the plurality of notch portions 60 are formed discontinuously on the circumference of each of the edge portions 41*b*' and 41*c*' of the second and third land portions 41*b* and 41*c*, the edge portions are formed in such a way partially exist in the land portions 41*b* and 41*c* respectively, and therefore foreign objects can be prevented from intruding into the clearance between the valve housing 40 and the spool 41.

In addition, because the solenoid valve in accordance with this Embodiment 1 is constructed in such a way that the width of each notch portion 60 in a direction of the circumference of the edge portion varies gradually along the direction of the axis of the spool 41, the amount of oil flow rises quickly when the solenoid valve control current varies from a value close to the intermediate current value. More specifically, the amount of oil flow varies with a small change in the solenoid valve control current, and the control response performance of the solenoid valve 30 whose solenoid valve control current has a value close to the intermediate current value is improved.

In addition, because the solenoid valve in accordance with this Embodiment 1 is constructed in such a way that each notch portion 60 is formed in the shape of an arc of less than a semicircle, the notch portions 60 and edge portions 41*b*' and 41*c*' of the second and third land portions 41*b* and 41*c* can be made to cross each other at an angle of 90 degrees or more, burrs can be prevented from occurring when the notch portions 60 are formed with machining.

Furthermore, because the solenoid valve in accordance with this Embodiment 1 is constructed in such a way that the three notch portions 60*a*, 60*b*, and 60*c* are formed at equal intervals in each of the second and third land portions 41*b* and 41*c*, variations in the amount of oil flow can be reduced even when the positional relationship between each of the ports 43, 44, 45, 46, and 47 formed in the housing 40 and the spool 41 differs.

In addition, because the solenoid valve in accordance with this Embodiment 1 is constructed in such a way that the notch portions 60 are formed with cutting, the notch portions can be machined with a high degree of precision by using cutting, and the flow amount characteristic of the solenoid valve can be adjusted with a high degree of accuracy.

In above-mentioned Embodiment 1, the structure in which the three notch portions 60*a*, 60*b*, and 60*c* are formed in each of the land portions 41*b* and 41*c* in such a way as to align at equal intervals in a direction of the circumference of the land portion is shown. As an alternative, four notch portions can be formed in each of the land portions 41*b* and 41*c* in such a way as to align at equal intervals in a direction of the circumference of the land portion. The number of notch portions 60 formed in each of the land portions is not particularly limited.

Embodiment 2.

Figure 6:
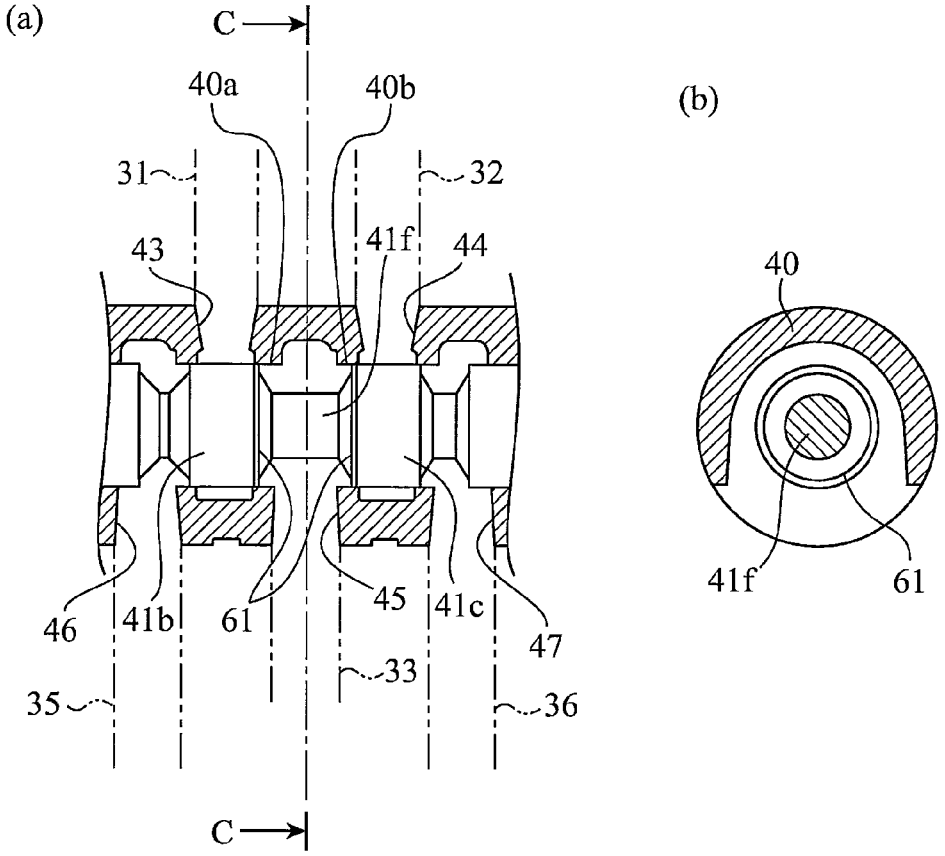
FIG. 6 is a view showing the structure of a solenoid valve in accordance with Embodiment 2.

FIG. 6 is a view showing the structure of a solenoid valve in accordance with Embodiment 2 of the present invention, and FIG. 6(*b*) is a cross-sectional view taken along the C-C line of FIG.

6(*a*). In above-mentioned Embodiment 1, the structure in which the arc-shaped notch portions 60*a*, 60*b*, and 60*c* are formed in each of the edge portions 41*b*' and 41*c*' of the second and the land portions 41*b* and 41*c*. In contrast, in this Embodiment 2, a structure in which a taper groove 61 is formed in each of edge portions of second and third land portions 41*b* and 41*c* is shown.

The taper groove 61 is formed on the circumference of each of the opposite edge portions of the second land portion 41*b* and the third land portion 41*c* in such a way as to continuously run in a direction of the circumference. In addition, the taper groove 61 is a groove having a tapered shape whose depth varies gradually along a direction of the axis of a spool 41, and the taper grooves 61 of the edge portions of the second and third land portion 41*b* and 41*c* are formed in such a way that their depths become shallower as the distances to the second and third land portions 41*b* and 41*c* decrease respectively, and their depths become deeper as the distances to a recessed portion 41*f* decrease respectively. This taper groove 61 can also be formed with cutting or the like.

When intermediately holding a VVT adjusting device 20, the solenoid valve 30 maintains a state in which an oil supply passage 33 is communicating with neither an advance angle side oil passage 31 nor a retard angle side oil passage 32, as shown in FIG. 6. Amounts of oil flow flowing through the taper grooves 61, in addition to amounts of oil leaking from the clearance parts between the second and third land portions 41*b* and 41*c*, and partition portions 40*a* and 40*b*, are supplied to the advance angle side and retard angle side oil passages 31 and 32 respectively. By disposing the taper grooves 61, the amount of oil flow at the point R shown in FIG. 5 can be ensured also in the case of intermediately holding the VVT adjusting device 20.

In contrast, in the case of operating the VVT adjusting device 20 on a retard angle side, in the solenoid valve 30, the spool 41 moves toward a direction so as to make the oil supply passage 33 and the retard angle side oil passage 32 communicate with each other. As a result, because the taper grooves 61 formed in the second and third land portions 41*b* and 41*c* are located in an oil supply side portion via which the oil supply passage 33 and the retard angle side oil passage 32 communicate with each other, and therefore no oil with an increased amount of flow is discharged into an advance angle side drain passage 35 via the taper grooves 61 and the amount of leakage of oil does not increase in the whole solenoid valve 30.

Similarly, in the case of operating the VVT adjusting device 20 on an advance angle side, in the solenoid valve 30, the spool 41 moves toward a direction so as to make the oil supply passage 33 and the advance angle side oil passage 31 communicate with each other. As a result, because the taper grooves 61 formed in the second and third land portions 41*b* and 41*c* are located in an oil supply side portion via which the oil supply passage 33 and the advance angle side oil passage 31 communicate with each other, and therefore no oil with an increased amount of flow is discharged into a retard angle side drain passage 36 via the taper grooves 61 and the amount of leakage of oil does not increase in the whole solenoid valve 30.

As mentioned above, in the solenoid valve in accordance with this Embodiment 2, because the taper groove 61 is formed on the circumference of each of the edge portions 41*b*' and 41*c*' of the second and third land portions 41*b* and 41*c* in such a way as to continuously run in a direction of the circumference, also when the solenoid valve 30 is controlled by using the solenoid valve control current having a value close to an intermediate current value, the oil flows via the taper grooves 61 can increase the amount of oil flow to the advance angle side and retard angle side oil passages 31 and 32, and the VVT adjusting device 20 can be controlled with stability. In addition, the flow amount characteristic of the oil supplied to the advance angle side and retard angle side oil passages 31 and 32 can be equalized.

Furthermore, since successive processing can be carried out and therefore the machining is facilitated, the manufacturing cost can be reduced.

Furthermore, in accordance with this Embodiment 2, because the taper grooves 61 are formed in such a way that their the depths vary gradually along the axial direction of the spool 41, the amount of oil flow rises quickly when the solenoid valve control current varies from a value close to the intermediate current value. More specifically, the amount of oil flow varies with a small change in the solenoid valve control current, and the control response performance of the solenoid valve 30 whose solenoid valve control current has a value close to the intermediate current value is improved.

Embodiment 3

Figure 7:
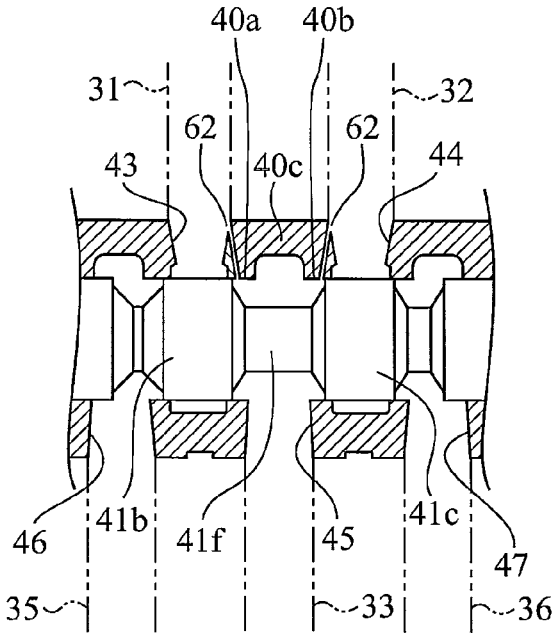
FIG. 7 is a view showing the structure of a solenoid valve in accordance with Embodiment 3.
Figure 8:
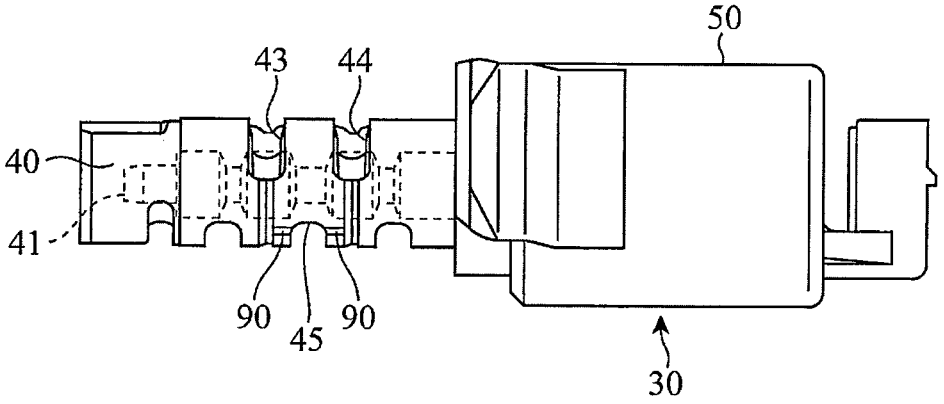
FIG.8 PRIOR ART
FIG. 8 is a view showing the structure of a conventional solenoid valve.

FIG. 7 is a view showing the structure of a solenoid valve in accordance with Embodiment 3 of the present invention. In above-mentioned Embodiments 1 and 2, the structure in which the notch portions 60*a*, 60*b*, and 60*c* or the taper groove 61 is formed in each of the second and third land portions 41*b* and 41*c* is shown. In contrast, in this Embodiment 3, a structure in which penetrating holes 62 are formed in parts of a valve housing 40*c* which are in contact with second and third land portions 41*b* and 41*c* respectively.

The penetrating holes 62 are formed in hole edge portions of the valve housing 40*c* in such a way that an oil flow passage between the second land portion 41*b* and the third land portion 41*c* can communicate with an advance angle side oil passage 31 and a retard angle side oil passage 32. These penetrating holes 62 can also be formed with cutting or the like. When intermediately holding a VVT adjusting device 20, the solenoid valve 30 maintains a state in which an oil supply passage 33 is communicating with neither the advance angle side oil passage 31 nor the retard angle side oil passage 32, as shown in FIG. 7. Amounts of oil flow flowing through the penetrating holes 62, in addition to amounts of oil leaking from the clearance parts between the second and third land portions 41*b* and 41*c*, and partition portions 40*a* and 40*b*, are supplied to the advance angle side and retard angle side oil passages 31 and 32 respectively. By disposing the penetrating holes 62, the amount of oil flow at the point R shown in FIG. 5 can be ensured also in the case of intermediately holding the VVT adjusting device 20.

In contrast, in the case of operating the VVT adjusting device 20 on a retard angle side, in the solenoid valve 30, the spool 41 moves toward a direction so as to make the oil supply passage 33 and the retard angle side oil passage 32 communicate with each other, and the penetrating hole 62 formed in the vicinity of the third land portion 41*c* maintains a state of communicating with the retard angle side oil passage 32 and the penetrating hole 62 formed in the vicinity of the second land portion 41*b* is blocked by the second land portion 41*b* and is therefore not communicating with the advance angle side oil passage 31. Thus, because the penetrating holes 62 are not open to the oil discharge side, no oil with an increased amount of flow is discharged into an advance angle side drain passage 35 via the penetrating holes 62 and the amount of leakage of oil does not increase in the whole solenoid valve 30.

Similarly, in the case of operating the VVT adjusting device 20 on an advance angle side, in the solenoid valve 30, the spool 41 moves toward a direction so as to make the oil supply passage 33 and the advance angle side oil passage 31 communicate with each other, and the penetrating hole 62 formed in the vicinity of the second land portion 41*b* maintains a state of communicating with the advance angle side oil passage 31 and the penetrating hole 62 formed in the vicinity of the third land portion 41*c* is blocked by the third land portion 41*c* and is therefore not communicating with the retard angle side oil passage 32. Thus, because the penetrating holes 62 are not open to the oil discharge side, no oil with an increased amount of flow is discharged into a retard angle side drain passage 36 via the penetrating holes 62 and the amount of leakage of oil does not increase in the whole solenoid valve 30.

As mentioned above, in the solenoid valve in accordance with this Embodiment 3, because the penetrating holes 62 are formed in the hole edge portions of the valve housing 40*c* in such a way that the oil flow passage between the second land portion 41*b* and the third land portion 41*c* can communicate with the advance angle side oil passage 31 and the retard angle side oil passage 32 when intermediately holding the VVT control device 20, also when the solenoid valve 30 is controlled by using the solenoid valve control current having a value close to the intermediate current value, the oil flows via the penetrating holes 62 can increase the amount of oil flow to the advance angle side and retard angle side oil passages 31 and 32, and the VVT adjusting device 20 can be controlled with stability. In addition, the flow amount characteristic of the oil supplied to the advance angle side and retard angle side oil passages 31 and 32 can be equalized.

In above-mentioned Embodiment 3, the structure in which the two penetrating holes 62 are formed in the hole edge portions of the valve housing 40*c* respectively is shown. As an alternative, a plurality of penetrating holes 62 can be formed in each of the hole edge portions of the valve housing 40*c* in such a way as to run at substantially-equal intervals in a direction of the circumference of the valve housing 40*c*.

INDUSTRIAL APPLICABILITY

As mentioned above, in accordance with the present invention, there is provided a solenoid valve for variable valve timing control devices which is configured in such a way as to include: in order to prevent the amount of oil leakage from increasing in the whole solenoid valve when operating the variable valve timing control device on an advance angle or retard angle side and to ensure an adequate amount of oil supply when operating the variable valve timing control device in an intermediate holding state, a valve housing of cylindrical shape in which a plurality of ports for supplying and discarding the above-mentioned working fluid to and from the above-mentioned variable valve timing control device are formed; a spool moving within the above-mentioned valve housing in a direction of an axis thereof to adjust the fed or discarded amount of the above-mentioned working fluid flowing via the above-mentioned ports according to an amount of the above-mentioned movement, and including a plurality of lands each consisting of a large-diameter portion, and recessed portions each consisting of a small-diameter portion for connecting the above-mentioned plurality of lands with one another; and a solenoid unit containing a plunger which is a moving member of a magnetic circuit for driving the above-mentioned spool, in which a groove portion for adjusting the amount of the working fluid which is close to an intermediate current value is formed in either an edge portion of the above-mentioned plurality of lands or a hole edge portion of the valve housing corresponding to the above-mentioned edge portion. Therefore, the solenoid valve in accordance with the present invention is suitable for use as a solenoid valve for a variable valve timing control devices which is disposed in order to rotate a camshaft relatively to a crankshaft in an engine, and so on.

The invention claimed is:

1. A solenoid valve for variable valve timing control devices which adjusts an amount of a working fluid fed or discarded to or from a variable valve timing control device equipped with a pushing member for pushing a rotor toward a direction of an advance angle, said solenoid valve comprising:

a valve housing of cylindrical shape which includes a plurality of ports for supplying and discarding said working fluid to and from said variable valve timing control device;

a spool moving within said valve housing in a direction of an axis thereof to adjust the fed or discarded amount of said working fluid flowing via said ports according to an amount of said movement, the spool including a plurality of lands each of which has a large-diameter portion, and recessed portions each of which has a small-diameter portion for connecting said plurality of lands with one another;

a solenoid unit for driving said spool; and a groove portion for allowing the working fluid to flow through said groove portion toward the ports of the valve housing when the solenoid valve is controlled with a current which is close to an intermediate current value of control current supplied to the solenoid valve, the groove potion being formed in an edge portion of said plurality of lands so that the groove portion is formed discontinuously along a direction of a circumference of the land.

2. The solenoid valve for variable valve timing control devices according to claim 1, wherein the groove portion is shaped like an arc of less than a semicircle with respect to the land.

3. The solenoid valve for variable valve timing control devices according to claim 1, wherein groove portions are formed at substantially-equal intervals in the direction of the circumference of the land or in a direction of a circumference of the hole edge portion of the valve housing.

4. The solenoid valve for variable valve timing control devices according to claim 1, wherein groove portions having an identical shape are formed in edge portions of lands opposite to each other.

5. The solenoid valve for variable valve timing control devices according to claim 1, wherein the groove portion is formed with cutting.

6. A variable valve timing control system comprising:

a housing for transmitting a driving force from a crankshaft to an intake camshaft or an exhaust camshaft;

a case fixed to said housing and having a plurality of shoes protruding toward an interior of said housing to form a plurality of oil pressure chambers;

a rotor fixed to an end portion of either said intake camshaft or said exhaust camshaft, and having a plurality of vanes which divide each of said plurality of oil pressure chambers into an advance angle side oil pressure chamber and a retard angle side oil pressure chamber;

a variable valve timing control device equipped with a pushing member for pushing said rotor toward a direction of an advance angle; and a solenoid valve for adjusting an amount of a working fluid fed or discarded to or from said advance angle side oil pressure chambers and said retard angle side oil pressure chambers of said variable valve timing control device, wherein said solenoid valve includes:

a valve housing of cylindrical shape which includes a plurality of ports for supplying and discarding said working fluid to and from said variable valve timing control device;

a spool moving within said valve housing in a direction of an axis thereof to adjust the fed or discarded amount of said working fluid flowing via said ports according to an amount of said movement, the spool including a plurality of lands each of which has a large-diameter portion, and recessed portions each of which has a small-diameter portion for connecting said plurality of lands with one another;

a solenoid unit for driving said spool; and a groove portion for allowing the working fluid to flow through said groove portion toward the ports of the valve housing when the solenoid valve is controlled with a current which is close to an intermediate current value of control current supplied to the solenoid valve, the groove potion being formed in an edge portion of said plurality of lands so that the groove portion is formed discontinuously along a direction of a circumference of the land.

* * * * *